US010335698B2

(12) United States Patent
Fish

(10) Patent No.: US 10,335,698 B2
(45) Date of Patent: Jul. 2, 2019

(54) TUMBLING TOY SYSTEM AND ITS ASSOCIATED METHOD OF OPERATION

(71) Applicant: KMA Concepts Limited, North Point (HK)

(72) Inventor: Peter Alan Fish, Wyong Creek (AU)

(73) Assignee: KMA Concepts Limited, North Point (HK)

( * ) Notice: Subject to any disclaimer, the term of this patent is extended or adjusted under 35 U.S.C. 154(b) by 0 days.

(21) Appl. No.: 16/134,944

(22) Filed: Sep. 18, 2018

(65) Prior Publication Data

US 2019/0134519 A1 May 9, 2019

(30) Foreign Application Priority Data

Nov. 6, 2017 (AU) ..... 2017101568

(51) Int. Cl.
*A63H 15/08* (2006.01)
*A63H 15/02* (2006.01)

(52) U.S. Cl.
CPC ..... *A63H 15/02* (2013.01)

(58) Field of Classification Search
USPC ..... 446/168, 324, 396, 431, 437, 445, 457, 446/458, 489
See application file for complete search history.

(56) References Cited

U.S. PATENT DOCUMENTS 1,272,588 A * 7/1918 White ..... A63H 11/08 446/324
1,383,316 A * 7/1921 Liebert ..... A63F 9/14 446/168
2,218,207 A * 10/1940 Herzinger ..... A63H 11/08 446/324
3,100,946 A 8/1963 Swanberg et al.
3,572,713 A * 3/1971 Krause ..... A63H 18/02 446/173
3,859,743 A * 1/1975 Schoenung ..... G09F 11/00 40/411
4,037,355 A 7/1977 Street
4,213,266 A * 7/1980 Hyland ..... A63H 15/08 446/431
5,575,702 A * 11/1996 Silvious ..... A63H 15/08 446/324

(Continued)

FOREIGN PATENT DOCUMENTS

CN 2267845 11/1997
CN 208097398 11/2018

*Primary Examiner* — Nini F Legesse
(74) *Attorney, Agent, or Firm* — LaMorte & Associates PC

(57) ABSTRACT

A tumbling toy system where a tumble pin tumbles in a guide track. The guide track has two sides and a bottom. The two sides are a first distance apart at a first elevation height. Each tumble pin rests in the guide track and is free to tumble end-over-end. As the tumble pin tumbles, the ends of the tumble pin cyclically contact the bottom of the guide track. Each tumble pin tapers from a maximum diameter at its midplane to a minimum diameter at either end. The maximum diameter of the tumble pin is larger than the distance between the two sides of the guide track. This causes the tumble pin to cyclically contact the two sides of the guide track as it tumbles. When the tumble pin contacts the sides of the guide track, the tumble pin becomes temporarily suspended between the two sides and tumbles in place.

20 Claims, 5 Drawing Sheets

(56) References Cited

U.S. PATENT DOCUMENTS

| | | | | |
|---|---|---|---|---|
| 6,786,495 | B1 * | 9/2004 | Browning | A63B 19/02 280/206 |
| 9,352,237 | B1 * | 5/2016 | Middleton | A63H 15/08 |
| 2006/0217029 | A1 | 9/2006 | Perry | |

* cited by examiner

TUMBLING TOY SYSTEM AND ITS ASSOCIATED METHOD OF OPERATION

RELATED APPLICATIONS

This application claims the benefit of Australian Innovation Patent No. 2017101568 filed Nov. 6, 2017.

BACKGROUND OF THE INVENTION

1. Field of the Invention

In general, the present invention relates to tumbling pin toys of the type that are shaped like elongated barrels or candlepin bowling pins. More particularly, the present invention relates to the dimensions of tumbling pin toys and auxiliary tracks that are used to guide the tumbling action of the tumbling pin toys.

2. Prior Art Description

Toy pins that are barrel-shaped with flat ends and a wide center have been used in play for centuries. Many games, such as candlepin bowling, use such pins. Such pins can stand straight on one end and are easily knocked down if contacted. Traditional candlepins and toys that use the candlepin design typically use pins with a length that is at least five times longer than the maximum diameter of the pin. This makes traditional candlepins appear long and skinny. It also enables the candlepins to interact and cause cascading falls when the candlepins are placed in a particular formation, such as in the game of bowling.

It has recently been discovered that when a candlepin is shortened and its exterior rounded, the pin can be caused to tumble end over end. That is, when the pin is stood on its end, it can be made to roll end-over-end and return to its standing position. This is typically accomplished by providing the pin with a length to width maximum ratio of just above 3:1, with a preferred ratio of Pi-to-one, i.e. 3.14:1. This ratio is combined with an exterior that has a uniform radius of curvature from end to end. Such prior art pins are sold under a variety of tradenames, including Kururin® by Comcell Co. Limited of Saitama, Japan. In the toy industry, such pins are typically referred to as tumbling pins or tumble pins.

Although toy tumbling pins are shorter than candlepins, they still have a relatively long length in relation to width. Since the toy tumbling pins tumble end over end, the toy tumbling pins travel a significant distance per rotation. The distance traveled by the toy tumbling pin is equal to the circumference of the toy tumbling pin. Since the toy tumbling pin travels significant distances with each rotation, the toy tumbling pin rarely rotates more than a few times before it runs out of room to tumble and/or runs out of momentum to sustain the tumble. This significantly reduces the play value of the toy. Interest in a tumbling toy quickly diminishes if the tumbling toy can only tumble a few times before its stops.

A need therefore exists for an improved toy tumbling pin that can be made to tumble a significant number of times in a short area. A need also exists for a system that can maintain momentum in a toy tumbling pin and keep it tumbling for longer periods of time. These needs are met by the present invention as described and claimed below.

SUMMARY OF THE INVENTION

The present invention is a tumbling toy system where at least one tumble pin is provided that tumbles in a guide track. The guide track extends a first length between two opposite ends. The guide track is defined by two sides and a bottom that extends between the two opposite ends, wherein the two sides are a first distance apart at a first elevation height above the bottom.

One or more tumble pins can be placed in the guide track. Each tumble pin has a midplane between two ends. Each tumble pin rests in the guide track and is free to tumble end-over-end within the guide track. As the tumble pin tumbles, the ends of the tumble pin cyclically contact the bottom of the guide track.

Each tumble pin tapers from a maximum diameter at its midplane to a minimum diameter at either end. The maximum diameter of the tumble pin is larger than the first distance between the two sides of the guide track. This causes the tumble pin to cyclically contact the two sides of the guide track as it tumbles. When the tumble pin contacts the sides of the guide track, the tumble pin becomes temporarily suspended between the two sides. This causes the tumble pin to tumble in place within the guide track until one of the ends of the tumble pin again contacts the bottom of the guide track. The cyclical suspension of the tumble pin enables the tumble pin to tumble multiple times while only progressing a short distance within the guide track.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention tumbling toy system can be configured in many ways, only one simple system has been selected for the purposes of explanation and illustration. The exemplary embodiment selected sets forth one of the best modes contemplated for the system. The selected embodiment, however, is merely exemplary and should not be considered a limitation when interpreting the scope of the appended claims.

Figure 1:
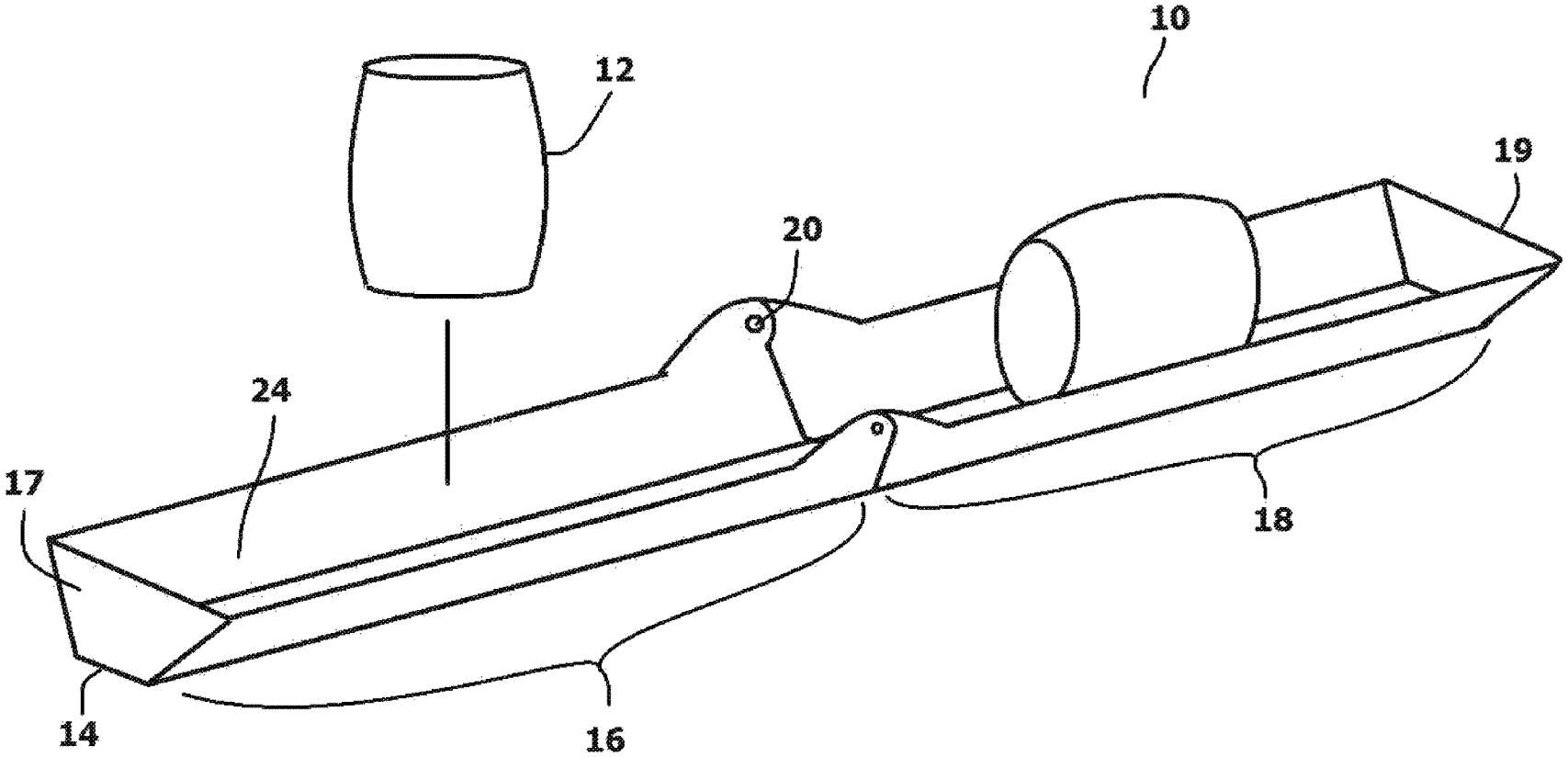
FIG. 1 is an exemplary embodiment of the tumbling toy system showing tumble pins along with a folding case in an open configuration.
Figure 2:
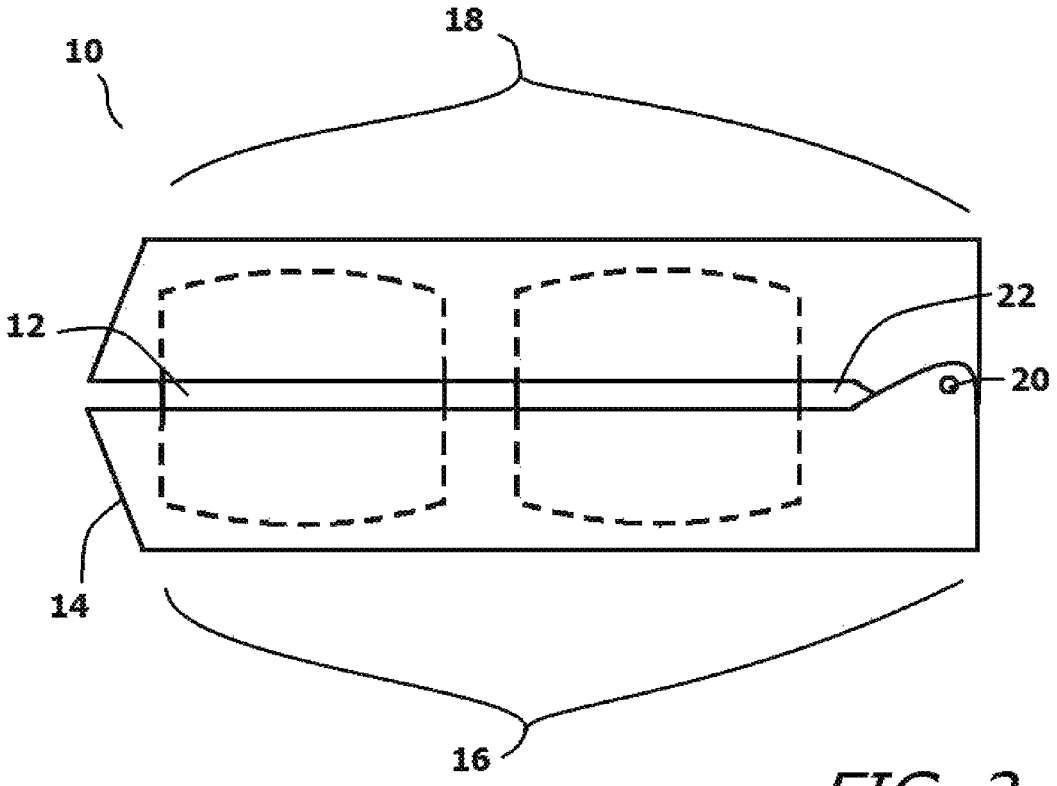
FIG. 2 shows the exemplary tumbling toy system with the tumble pins held within the folding case while the folding case is in its folded configuration.

Referring to FIG. 1, in conjunction with FIG. 2, the present invention tumbling toy system 10 is shown. The tumbling toy system 10 includes one or more tumble pins 12 held within a folding case 14. The folding case 14 has a clamshell design where a first section 16 and a second section 18 are joined at a hinge joint 20. The folding case 14 can be selectively manipulated between an open configuration (FIG. 1) and a folded configuration (FIG. 2). When in the folded configuration, the folding case 14 defines an internal storage area 22 that is sized to hold one or more tumble pins 12. When the folding case 14 is in its open configuration, the folding case 14 defines a guide track 24 in which the tumble pins 12 can tumble. When open, the guide track 24 extends linearly between two opposing ends 17, 19. The tumble pins 12 and the guide track 24 have features that optimize the ability of the tumble pins 12 to tumble within the guide track 24, as is later explained. Furthermore, by holding the folding case 14 in its open configuration and manipulating the guide track 24 to teeter, the tumble pins 12 can be caused to repeatedly tumble back and forth.

Figure 3:
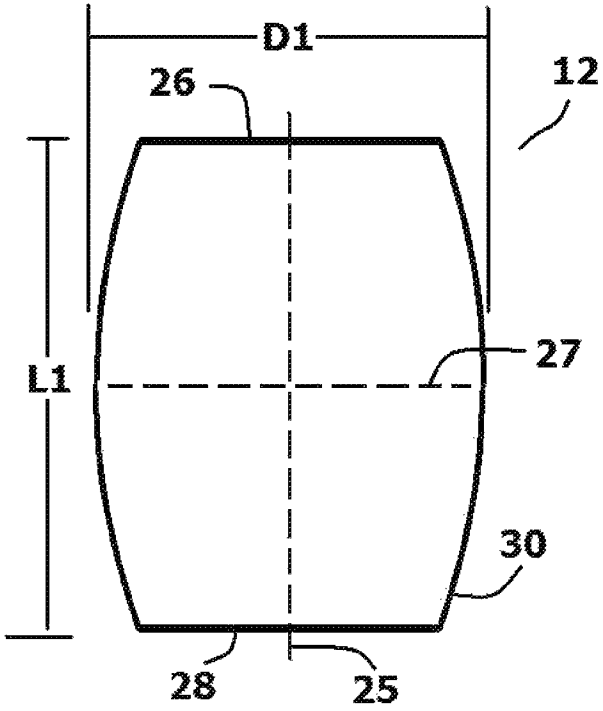
FIG. 3 shows a front view of a tumble pin.

Referring to FIG. 3, it can be seen that each tumble pin 12 has a flat first end 26, a flat second end 28 and a long axis 25 of length L1 that extends between the first end 26 and the second end 28. The long axis 25 is bisected at a perpendicular by a midplane 27. Both the first end 26 and the second end 28 are parallel to the midplane 27. Each tumble pin 12 also has an exterior wall 30 that is curved to embody a constant radius of curvature between the first end 26 and the second end 28. The radius of curvature is preferably equal to or less than the length L1.

Due to the radius of curvature, each tumble pin 12 is widest at the midplane 27 between the first end 26 and the second end 28. The midplane 27 has a diameter D1 which is between ten percent and twenty-five percent larger than the diameter of the first end 26 and the second end 28. The preferred length is 48 mm. This preferred length can be varied by +/−15%. The preferred diameter D1 is 28 mm, this value can also be varied by +/−15% in proportion to any concurrent variation of the length L1. Given the preferred dimensions, it can be seen that the length to diameter ratio is less than 2:1. This is significantly smaller than the corresponding ratios of prior art tumble pins. This makes the tumble pins 12 of the current system less elongated and more squat. By making the tumble pins 12 more squat, the tumble pins 12 retain more of their momentum after each tumble. The downside to retaining momentum is that the tumble pins 12 are more likely to roll in an undesired direction rather than tumble in a straight line. This loss in directional stability is not an issue because of the manner in which the tumble pins 12 interact with the guide track 24 created by the folding case 14.

Figure 4:
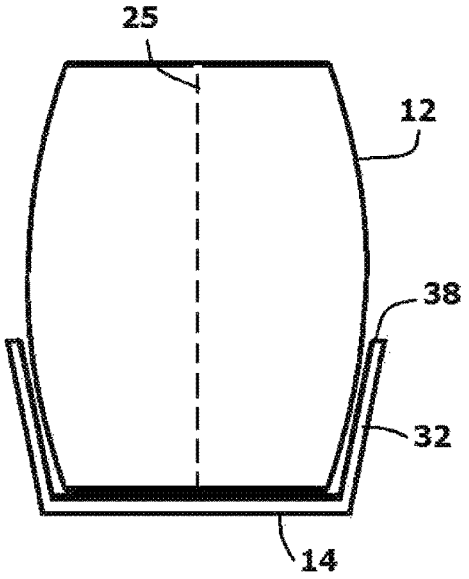
FIG. 4 shows a tumble pin standing upright in a guide track within the folding case.
Figure 5:
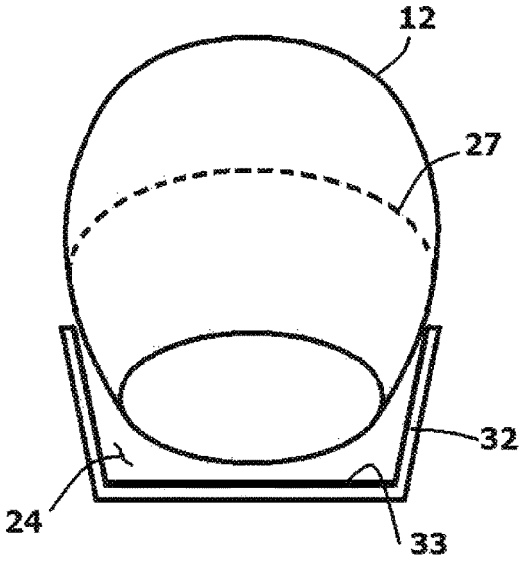
FIG. 5 shows a tumble pin suspended between the side walls of the guide track within the folding case.

Referring to FIG. 4 and FIG. 5 in conjunction with FIG. 3, it will be understood that when the folding case 14 is unfolded into its open configuration, the linear guide track 24 is formed. The guide track 24 has two side walls 32 that define a uniform trough from a first end 34 to an opposite second end 36. The guide track 24 has a bottom surface 33 interposed between the side walls 32, wherein the side walls 32 extend above the bottom surface 33. The top edges 38 of the side walls 32 are parallel and act as parallel rails that are spaced a measured distance apart at a first elevation above the bottom surface 33. The distance between the top edges 38 of the side walls 32 is just slightly smaller than the maximum diameter D1 at the midplane 27 of the tumble pin 12.

As is shown in FIG. 4 and FIG. 5, it will be understood that the tumble pin 12 has a tip angle. The tumble pin 12 can stand on either its first end 26 or its second end 28. When standing in such an orientation, the long axis 25 is vertical. When the tumble pin 12 is standing on one of its flat ends 26, 28 in the guide track 24, the tumble pin 12 rests on the bottom surface 33 between the side walls 32. The tumble pin 12 does not contact the side walls 32 or the top edges 38 of the side walls 32. However, when the tumble pin 12 is tipped passed its tipping angle, gravity causes it to fall over. The long axis 25 moves from a vertical orientation toward a horizontal orientation. As the tumble pin 12 tips and falls, the midplane 27 descends into the guide track 24. Accordingly, the tumble pin 12 falls and contacts the side walls 32 at, or near, the midplane 27. The contact between the middle of the tumble pin 12 and the side walls 32 acts as a fulcrum pivot, wherein the tumble pin 12 loses contact with the bottom surface 33 of the guide track 24 and the tumble pin 12 begins to rotate in place.

Figure 6:
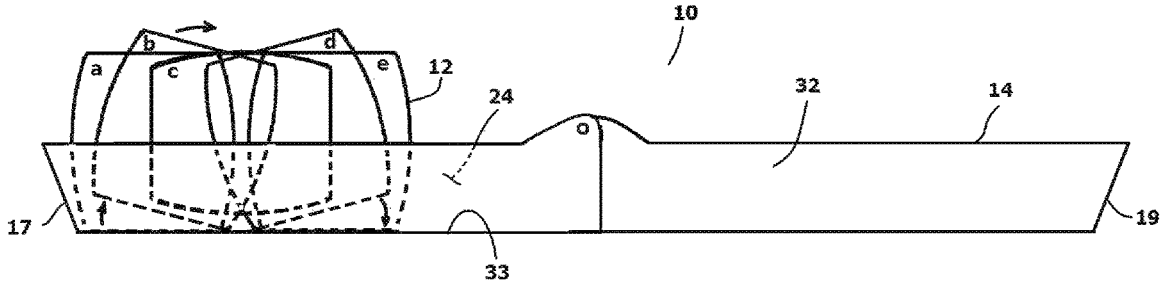
FIG. 6 shows a tumbling progression of a tumble pin tumbling in the guide track of the folding case.

Referring to FIG. 6 in conjunction with FIG. 4 and FIG. 5, it can be seen that the tumble pin 12 will rotate in place until the long axis 25 of the tumble pin 12 approaches vertical and the tumble pin 12 again contacts the bottom surface 33 of the guide track 24. Once the tumble pin 12 rotates around to again contact the bottom surface 33 of the guide track 24, its momentum lifts the tumble pin 12 out of contact with the side walls 32. The tumble pin 12 will then move slightly forward as it contacts the bottom surface 33, stands straight, and again falls.

Since the tumble pin 12 only moves laterally in the guide track 24 during part of its rotation, the tumble pin 12 is capable of turning multiple times in a relatively short guide track 24. In the exemplary embodiment, the tumble pin 12 has a length of 48 mm and a maximum diameter of 28 mm. Accordingly, its bisected circumference is approximately 95 mm-100 mm. This means that if tumbled on an open surface, the tumble pin 12 could travel approximately 100 mms per full rotation. In the exemplary embodiment, the guide track 24 has a length of approximately 295 mms between its two ends 17, 19. This length is not long enough for even three full rotations of the tumble pin 12. However, since the tumble pin 12 partially spins in place as it is suspended between the side walls 32 of the guide track 24, the tumble pin 12 may be able to spin through as many as ten rotations as it travels the length of the guide track 24. This adds significantly to the play value of the tumbling toy system 10.

Additionally, since the tumble pin 12 is held within the guide track 24 of the folding case 14, the guide track 24 can be slanted by inclining the folding case 14. The folding case 14 can be tilted back and forth to cause the guide track 24 to teeter and the tumble pin 12 to tumble back and forth within the guide track 24. The tumble pin 12 can, therefore, be kept tumbling back and forth for as long as the folding case 14 is manipulated.

It will be understood that the embodiment of the present invention that is illustrated and described is merely exemplary and that a person skilled in the art can make many variations to that embodiment. All such embodiments are intended to be included within the scope of the present invention as defined by the appended claims.

What is claimed is:

1. A tumbling toy system, comprising:

a guide track having two sides and a bottom that extend between two opposite ends, wherein said two sides are a first distance apart at a first elevation above said bottom;

a tumble pin resting in said guide track that is free to tumble within said guide track, said tumble pin having a first length between a first end and an opposite second end, and a midplane between said first end and said second end, wherein said first end and said second end of said tumble pin cyclically contact said bottom of said guide track as said tumble pin tumbles within said guide track;

wherein said tumble pin tapers from a maximum diameter at said midplane to a minimum diameter at both said first end and said second end, and wherein said maximum diameter is larger than said first distance between said two sides, therein causing said tumble pin to cyclically contact said two sides and become temporarily suspended between said two sides as said tumble pin tumbles within said guide track.

2. The system according to claim 1, wherein said guide track has a first section and a second section between said two opposite ends.

3. The system according to claim 2, wherein said first section and said second section of said guide track are joined by a hinge connection that enables said guide track to be selectively manipulated between an open configuration and a folded configuration.

4. The system according to claim 3, wherein said first section and said second section of said guide track define an internal storage area when in said folded configuration, and wherein said internal storage area is large enough to hold said tumble pin therein.

5. The system according to claim 1, wherein said first end and said second end are both flat and parallel to said midplane.

6. The system according to claim 1, wherein said first length of said tumble pin is no greater than twice said maximum diameter of said tumble pin.

7. The system according to claim 1, wherein said maximum diameter of said tumble pin is between ten percent and twenty five percent greater than said minimum diameter of said tumble pin.

8. A tumbling toy system, comprising:

a folding case that can be opened into a linear guide track, wherein said guide track has two sides and a bottom that extend between two opposite ends;

a tumble pin resting in said guide track and free to tumble within said guide track, said tumble pin having a first end, a second end, a midplane between said first end and said second end, and a tip angle where gravity causes said tumble pin resting on said first end to tip over;

wherein said sides of guide track do not contact said tumble pin when said tumble pin is oriented in said guide track at a first angle less than said tip angle, and wherein said sides of said guide track contact and suspend said tumble pin in said guide track when said tumble pin is oriented in said guide track at a second angle greater than said tip angle, therein temporarily suspending said tumble pin between said two sides as said tumble pin tumbles within said guide track.

9. The system according to claim 8, wherein said tumble pin tapers from a maximum diameter at said midplane to a minimum diameter at both said first end and said second end.

10. The system according to claim 8, wherein said folding case has a first section and a second section that divides said guide track into two parts.

11. The system according to claim 10, wherein said first section and said second section of said folding case are joined by a hinge connection that enables said folding case to be selectively manipulated between an open configuration and a folded configuration.

12. The system according to claim 11, wherein said first section and said second section of said folding case define an internal storage area when in said folded configuration, and wherein said internal storage area is large enough to hold said tumble pin therein.

13. The system according to claim 8, wherein said first end and said second end of said tumble pin are both flat and parallel to said midplane.

14. The system according to claim 8, wherein said tumble pin has a long axis that is perpendicular to said midplane, wherein said tumbling pin has a first length along said long axis and said midplane has a first diameter, wherein said first length is no greater than twice said first diameter.

15. A tumbling toy system, comprising:

a tumble pin having a long axis of a first length between a first end and an opposite second end, and a midplane of a first diameter that is perpendicular to said long axis;

a guide track that guides said tumble pin as it tumbles, wherein said guide track guides said tumble pin to keep said long axis in a vertical plane as said tumble pin tumbles, wherein said guide track has a bottom surface that is only contacted by said first end and said second end of said tumble pin as said tumble pin tumbles.

16. The system according to claim 15, wherein said guide track has two sides, wherein said tumble pin cyclically contacts said two sides and becomes temporarily suspended between said two sides as said tumble pin tumbles within said guide track.

17. The system according to claim 15, wherein said guide track has a first section and a second section between two opposite ends.

18. The system according to claim 15, wherein said first section and said second section of said guide track are joined by a hinge connection that enables said guide track to be selectively manipulated between an open configuration and a folded configuration.

19. The system according to claim 18, wherein said first section and said second section of said guide track define an internal storage area when in said folded configuration, and wherein said internal storage area is large enough to hold said tumble pin therein.

20. The system according to claim 15, wherein said first length of said long axis is no greater than twice said first diameter of said midplane.

* * * * *